US012492827B2

(12) United States Patent
Lafleur et al.

(10) Patent No.: US 12,492,827 B2
(45) Date of Patent: Dec. 9, 2025

(54) ENERGY RECOVERY IN A MAKE-UP AIR MODULE OF AN AIR CONDITIONER APPLIANCE

(71) Applicant: Haier US Appliance Solutions, Inc., Wilmington, DE (US)

(72) Inventors: Robert Jules Lafleur, Louisville, KY (US); Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 141 days.

(21) Appl. No.: 18/435,645

(22) Filed: Feb. 7, 2024

(65) Prior Publication Data

US 2025/0251145 A1 Aug. 7, 2025

(51) Int. Cl.
*F24F 1/0063* (2019.01)
*F24F 1/0025* (2019.01)
*F24F 1/0033* (2019.01)

(52) U.S. Cl.
CPC ..... *F24F 1/0063* (2019.02); *F24F 1/0025* (2013.01); *F24F 1/0033* (2013.01)

(58) Field of Classification Search
CPC ..... F24F 1/0063; F24F 1/0025; F24F 1/0033; F24F 1/16
USPC ..... 165/48.1
See application file for complete search history.

(56) References Cited

U.S. PATENT DOCUMENTS

| | | | | |
|---|---|---|---|---|
| 5,573,058 | A | 11/1996 | Rolin | |
| 7,802,443 | B2 | 9/2010 | Wetzel | |
| 10,247,429 | B2 * | 4/2019 | Rissler | F24F 11/30 |
| 10,788,226 | B2 * | 9/2020 | Chapin | F24F 11/0001 |
| 11,175,054 | B2 * | 11/2021 | Shaffer | F24F 13/1486 |
| 11,313,571 | B2 | 4/2022 | Patel et al. | |
| 11,655,990 | B2 | 5/2023 | Chen et al. | |
| 2017/0176027 | A1 * | 6/2017 | Eicher | F24F 13/28 |
| 2018/0347836 | A1 * | 12/2018 | Fradkin | F24F 11/72 |
| 2023/0250973 | A1 | 8/2023 | Fulda | |
| 2025/0035323 | A1 * | 1/2025 | Merlino | F24F 13/28 |

FOREIGN PATENT DOCUMENTS

| | | |
|---|---|---|
| CN | 204612004 U | 9/2015 |
| CN | 108917020 A | 11/2018 |

* cited by examiner

*Primary Examiner* — Jon T. Schermerhorn, Jr.
(74) *Attorney, Agent, or Firm* — Dority & Manning, P.A.

(57) ABSTRACT

An air conditioner unit includes a bulkhead defining an indoor portion and an outdoor portion, a vent aperture defined in the bulkhead, and a make-up air module for urging a flow of make-up air from the outdoor portion through the vent aperture to the indoor portion. The make-up air module includes a heat exchanger defining a primary flow path and an auxiliary flow path, wherein the primary flow path is fluidly isolated and thermally coupled to the auxiliary flow path, an energy recovery duct providing fluid communication between the indoor portion and the auxiliary flow path, a primary fan fluidly coupled to the primary flow path for urging the flow of make-up air into the indoor portion through the vent aperture, and an auxiliary fan fluidly coupled to the auxiliary flow path for drawing a flow of auxiliary air through the energy recovery duct and the auxiliary flow path.

20 Claims, 9 Drawing Sheets

ENERGY RECOVERY IN A MAKE-UP AIR MODULE OF AN AIR CONDITIONER APPLIANCE

FIELD OF THE INVENTION

The present disclosure relates generally to air conditioner units, and more particularly to make-up air modules for packaged terminal air conditioner units.

BACKGROUND OF THE INVENTION

Air conditioner or conditioning units are conventionally utilized to adjust the temperature indoors, e.g., within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed indoors that is connected to another portion located outdoors, e.g., by tubing or conduit carrying refrigerant. These types of units are typically used for conditioning the air in larger spaces.

Another type of air conditioner unit, commonly referred to as single-package vertical units (SPVU) or package terminal air conditioners (PTAC), may be utilized to adjust the temperature in somewhat smaller indoor spaces, for example, a single room or group of rooms of a structure. These units typically operate like split heat pump systems, except that the indoor and outdoor portions are defined by a bulkhead and all system components are housed within a single package that installed in a wall sleeve positioned within an opening of an exterior wall of a building.

PTACs often need to draw air from the outdoor portion into the indoor portion. Accordingly, certain PTACs allow for the introduction of make-up air into the indoor space, e.g., through a vent aperture defined in the bulkhead that separates the indoor and outdoor side of the unit. The vent aperture is usually equipped with a fan and/or make-up air module to urge a flow of make-up air from the outdoor side of the PTAC into the conditioned room. Notably, PTACs that use a make-up air module for supplying make-up air from outdoors often suffer from inefficiencies. For example, the addition of outdoor make-up air adds a large amount of heat load to the space being conditioned.

Accordingly, an air conditioner unit with improved efficiency would be useful. More specifically, a PTAC that is capable of utilizing make-up air without excessive energy losses associated with the use of outdoor make-up air would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, an air conditioner unit is provided including a bulkhead defining an indoor portion and an outdoor portion, a vent aperture defined in the bulkhead, and a make-up air module for urging a flow of make-up air from the outdoor portion through the vent aperture to the indoor portion. The make-up air module includes a heat exchanger defining a primary flow path and an auxiliary flow path, wherein the primary flow path is fluidly isolated and thermally coupled to the auxiliary flow path, an energy recovery duct providing fluid communication between the indoor portion and the auxiliary flow path, a primary fan fluidly coupled to the primary flow path for urging the flow of make-up air into the indoor portion through the vent aperture, and an auxiliary fan fluidly coupled to the auxiliary flow path for drawing a flow of auxiliary air through the energy recovery duct and the auxiliary flow path.

In another exemplary embodiment, a make-up air module for an air conditioner unit is provided. The air conditioner unit includes a bulkhead defining an indoor portion and an outdoor portion and a vent aperture defined in the bulkhead. The make-up air module includes a heat exchanger defining a primary flow path and an auxiliary flow path, wherein the primary flow path is fluidly isolated and thermally coupled to the auxiliary flow path, an energy recovery duct providing fluid communication between the indoor portion and the auxiliary flow path, a primary fan fluidly coupled to the primary flow path for urging a flow of make-up air into the indoor portion through the vent aperture, and an auxiliary fan fluidly coupled to the auxiliary flow path for drawing a flow of auxiliary air through the energy recovery duct and the auxiliary flow path.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
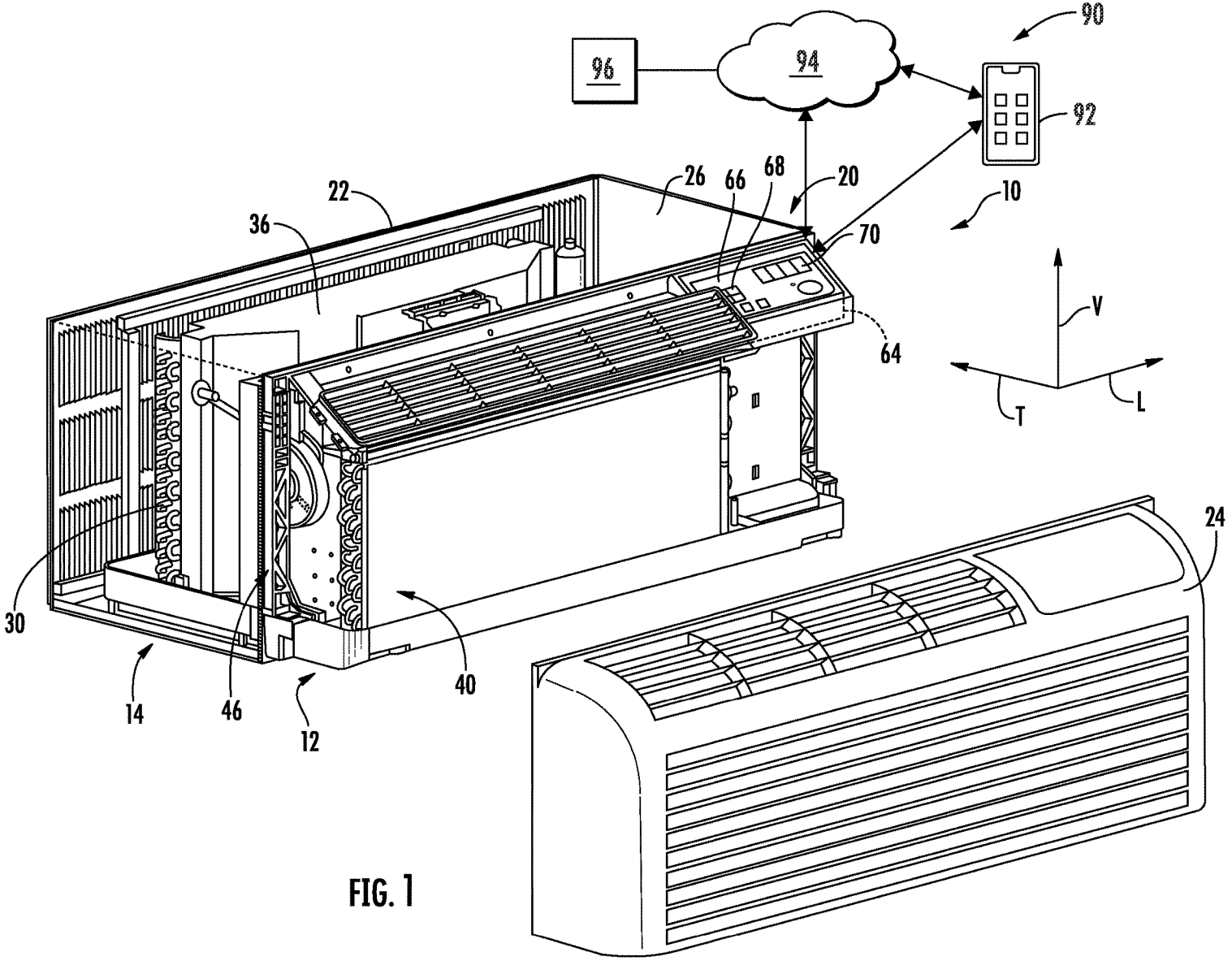
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Furthermore, as used herein, terms of approximation, such as "approximately," "substantially," or "about," refer to being within a ten percent margin of error.

Figure 2:
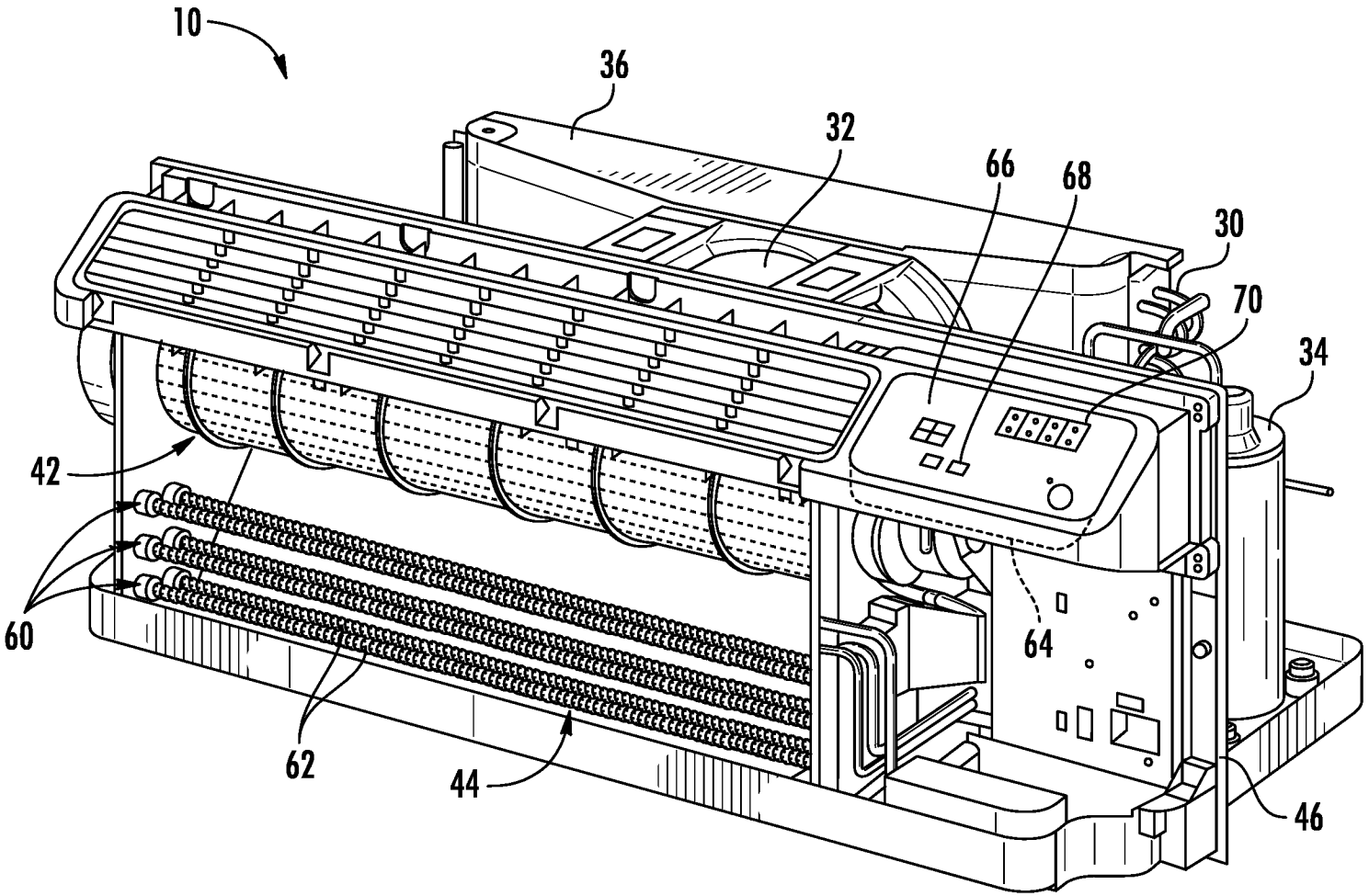
FIG. 2 is another perspective view of components of the indoor portion of the exemplary air conditioner unit of FIG. 1.

Referring now to FIGS. 1 and 2, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined. Although aspects of the present subject matter are described with reference to PTAC unit 10, it should be appreciated that aspects of the present subject matter may be equally applicable to other air conditioner unit types and configurations, such as single package vertical units (SPVUs) and split heat pump systems.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32, and a compressor 34 may be housed within the wall sleeve 26. A fan shroud 36 may additionally enclose outdoor fan 32, as shown.

Indoor portion 12 may include, for example, an indoor heat exchanger 40, a blower fan or indoor fan 42, and a heating unit 44. These components may, for example, be housed behind the room front 24. Additionally, a bulkhead 46 may generally support and/or house various other components or portions thereof of the indoor portion 12, such as indoor fan 42 and the heating unit 44. Bulkhead 46 may generally separate and define the indoor portion 12 and outdoor portion 14.

Figure 3:
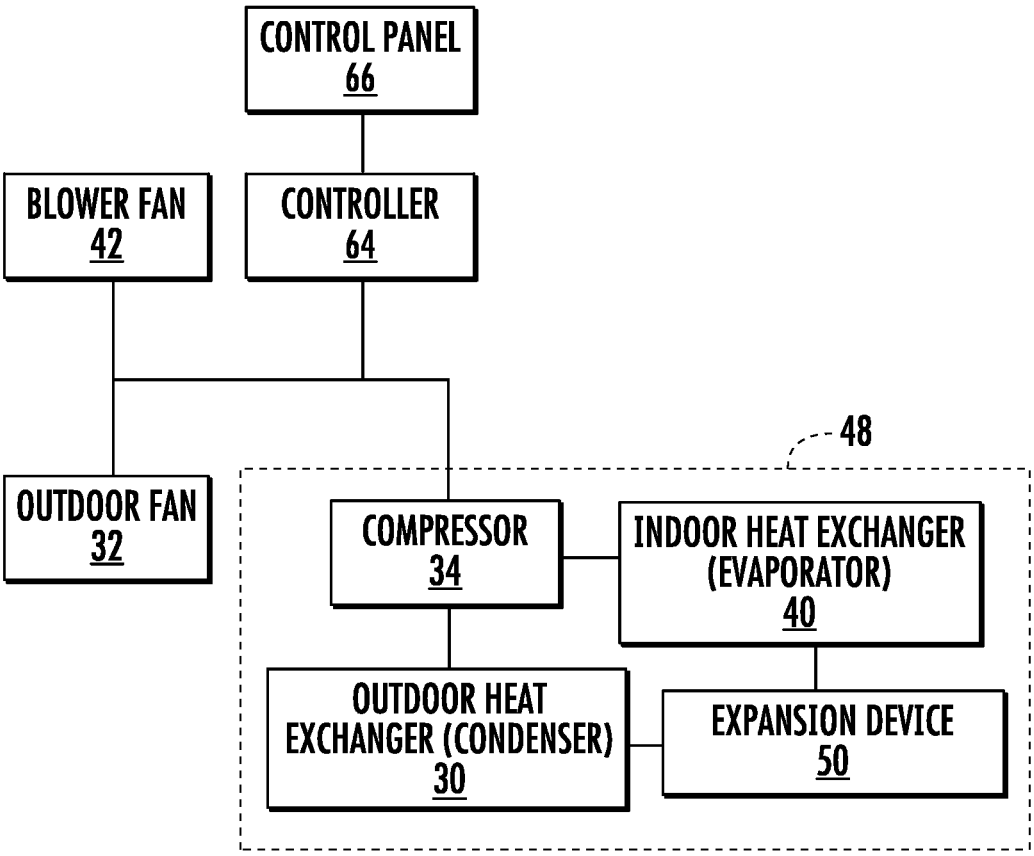
FIG. 3 is a schematic view of a refrigeration loop in accordance with one embodiment of the present disclosure.

Outdoor and indoor heat exchangers 30, 40 may be components of a sealed system or refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such examples and rather that any suitable refrigerant may be utilized.

As is understood in the art, refrigeration loop 48 may be alternately operated as a refrigeration assembly (and thus perform a refrigeration cycle) or a heat pump (and thus perform a heat pump cycle). As shown in FIG. 3, when refrigeration loop 48 is operating in a cooling mode and thus performing a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

Specifically, according to an exemplary embodiment, compressor 34 may be an inverter compressor. In this regard, compressor 34 may include a power inverter, power electronic devices, rectifiers, or other control electronics suitable for converting an alternating current (AC) power input into a direct current (DC) power supply for the compressor. The inverter electronics may regulate the DC power output to any suitable DC voltage that corresponds to a specific operating speed of compressor. In this manner compressor 34 may be regulated to any suitable operating speed, e.g., from 0% to 100% of the full rated power and/or speed of the compressor. This may facilitate precise compressor operation at the desired operating power and speed, thus meeting system needs while maximizing efficiency and minimizing unnecessary system cycling, energy usage, and noise.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be an electronic expansion valve ("EEV") that enables controlled expansion of refrigerant, as is known in the art. According to alternative embodiments, expansion device 50 may be a capillary tube or another suitable expansion device configured for use in a thermodynamic cycle.

More specifically, according to exemplary embodiments, electronic expansion device 50 may be configured to precisely control the expansion of refrigerant to maintain, for example, a desired temperature differential of the refrigerant across the evaporator (i.e., the outdoor heat exchanger 30 in heat pump mode). In other words, electronic expansion device 50 throttles the flow of refrigerant based on the reaction of the temperature differential across the evaporator or the amount of superheat temperature differential, thereby ensuring that the refrigerant is in the gaseous state entering compressor 34.

In general, the terms "superheat," "operating superheat," or the like are generally intended to refer to the temperature increase of the refrigerant past the fully saturated vapor temperature in the evaporator. In this regard, for example, the superheat may be quantified in degrees Fahrenheit, e.g., such that 1° F. superheat means that the refrigerant exiting the evaporator is 1° F. higher than the saturated vapor temperature. It should be appreciated that the operating superheat may be measured and monitored by controller 64 in any suitable manner. For example, controller 64 may be operably coupled to a pressure sensor for measuring the refrigerant pressure exiting the evaporator, may convert that pressure to the saturated vapor temperature, and may subtract that temperature from the measured refrigerant temperature at the evaporator outlet to determine superheat.

According to exemplary embodiments, expansion device or electronic expansion valve 50 may be driven by a stepper motor or other drive mechanism to any desirable position between a fully closed position (e.g., when no refrigerant passes through EEV 50) to a fully open position (e.g., when there is little or no restriction through the EEV 50). For example, controller 64 may be operably coupled to EEV 50 and may regulate the position of the EEV 50 through a control signal to achieve a target superheat, a target restriction/expansion, etc.

More specifically, the control signal communicated from controller 64 may specify the number of control steps (or simply "steps") and a corresponding direction (e.g., counterclockwise toward the closed position or clockwise toward the open position). Each EEV 50 may have a physical stroke span equal to the difference between the fully open position and the fully closed position. In addition, the EEV 50 may include a step range or range of control steps that correspond to the number adjustment steps it takes for the EEV 50 to travel from the fully closed position to the fully open position.

Each "step" may refer to a predetermined rotation of the drive mechanism, e.g., such as a stepper motor, which may in turn move the EEV 50 a fixed linear distance toward the open or closed position (depending on the commanded step direction). For example, according to the exemplary embodiment, the EEV 50 may have a step range of 500 steps, with 0 steps corresponding to fully closed and 500 steps corresponding to fully open. However, it should be appreciated that according to alternative embodiments, any given electronic expansion valve may include a different number of control steps, and the absolute step adjustments described herein may be varied accordingly.

In addition, as used herein, the position of EEV 50 may be expressed as a percentage, e.g., where 0% corresponds to a fully closed position and 100% corresponds to a fully open position. According to exemplary embodiments, this percentage representation may also refer to the percentage of total control steps taken from the closed position, e.g., with 10% referring to 50 steps (e.g., 10% of the 500 total steps), 100% referring to 400 steps (e.g., 100% of 500 total steps), etc.

According to the illustrated exemplary embodiment, outdoor fan 32 is an axial fan and indoor fan 42 is a centrifugal fan. However, it should be appreciated that according to alternative embodiments, outdoor fan 32 and indoor fan 42 may be any suitable fan type. In addition, according to an exemplary embodiment, outdoor fan 32 and indoor fan 42 are variable speed fans, e.g., similar to variable speed compressor 34. For example, outdoor fan 32 and indoor fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, indoor fan 42 may operate as an evaporator fan in refrigeration loop 48 to encourage the flow of air through indoor heat exchanger 40. Accordingly, indoor fan 42 may be positioned downstream of indoor heat exchanger 40 along the flow direction of indoor air and downstream of heating unit 44. Alternatively, indoor fan 42 may be positioned upstream of indoor heat exchanger 40 along the flow direction of indoor air and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) indoor fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. Controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66 and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 7:
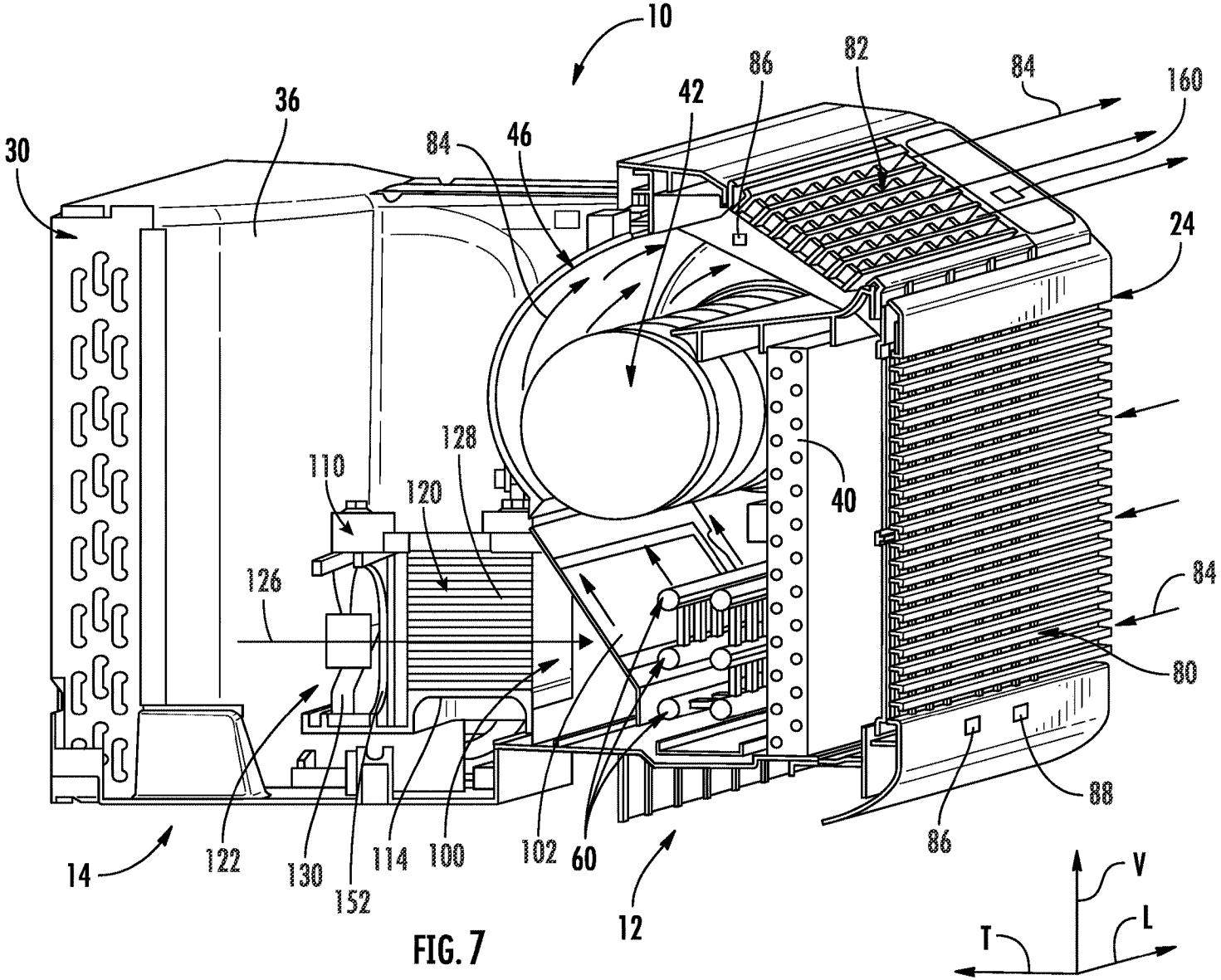
FIG. 7 is a rear perspective view of the exemplary air conditioner unit and bulkhead of FIG. 4 including a fan assembly for providing make-up air in accordance with one embodiment of the present disclosure.

Referring now briefly to FIG. 7, operation of unit 10 will be described according to an exemplary embodiment. More specifically, the operation of components within indoor portion 12 will be described during a cooling operation or cooling cycle of unit 10. Although a cooling cycle will be described, it should be further appreciated that indoor heat exchanger 40 and/or heating unit 44 be used to heat indoor air according to alternative embodiments. Moreover, although operation of unit 10 is described below for the exemplary packaged terminal air conditioner unit, it should be further appreciated that aspects the present subject matter may be used in any other suitable air conditioner unit, such as a heat pump or split unit system.

As illustrated, room front 24 of unit 10 generally defines an intake vent 80 and a discharge vent 82 for use in circulating a flow of air (indicated by arrows 84) throughout a room. In this regard, indoor fan 42 is generally configured for drawing in air 84 through intake vent 80 and urging the flow of air through indoor heat exchanger 40 before discharging the air 84 out of discharge vent 82. According to the illustrated embodiment, intake vent 80 is positioned proximate a bottom of unit 10 and discharge vent 82 is positioned proximate a top of unit 10. However, it should be appreciated that according to alternative embodiments, intake vent 80 and discharge vent 82 may have any other suitable size, shape, position, or configuration.

During a cooling cycle, refrigeration loop 48 is generally configured for urging cold refrigerant through indoor heat exchanger 40 in order to lower the temperature of the flow of air 84 before discharging it back into the room. Specifically, during a cooling operation, controller 64 may be provided with a target temperature, e.g., as set by a user for the desired room temperature. In general, components of refrigeration loop 48, outdoor fan 32, indoor fan 42, and other components of unit 10 operate to continuously cool the flow of air.

In order to facilitate operation of refrigeration loop 48 and other components of unit 10, unit 10 may include a variety of sensors for detecting conditions internal and external to the unit 10. These conditions can be fed to controller 64 which may make decisions regarding operation of unit 10 to rectify undesirable conditions or to otherwise condition the flow of air 84 into the room. For example, as best illustrated in FIG. 7, unit 10 may include an indoor temperature sensor 86 which is positioned and configured for measuring the indoor temperature within the room. In addition, unit 10 may include an indoor humidity sensor 88 which is positioned and configured for measuring the indoor humidity within the room. In this manner, unit 10 may be used to regulate the flow of air 84 into the room until the measured indoor temperature reaches the desired target temperature and/or humidity level. According to exemplary embodiments, unit 10 may further include an outdoor temperature sensor for measuring ambient outdoor temperatures.

As used herein, "temperature sensor" or the equivalent is intended to refer to any suitable type of temperature measuring system or device positioned at any suitable location for measuring the desired temperature. Thus, for example, temperature sensor 86 may each be any suitable type of temperature sensor, such as a thermistor, a thermocouple, a resistance temperature detector, a semiconductor-based integrated circuit temperature sensor, etc. In addition, temperature sensor 86 may be positioned at any suitable location and may output a signal, such as a voltage, to a controller that is proportional to and/or indicative of the temperature being measured. Although exemplary positioning of temperature sensors is described herein, it should be appreciated that unit 10 may include any other suitable number, type, and position of temperature, and/or other sensors according to alternative embodiments.

As used herein, the terms "humidity sensor" or the equivalent may be intended to refer to any suitable type of humidity measuring system or device positioned at any suitable location for measuring the desired humidity. Thus, for example, humidity sensor 88 may refer to any suitable type of humidity sensor, such as capacitive digital sensors, resistive sensors, and thermal conductivity humidity sensors. In addition, humidity sensor 88 may be positioned at any suitable location and may output a signal, such as a voltage, to a controller that is proportional to and/or indicative of the humidity being measured. Although exemplary positioning of humidity sensors is described herein, it should be appreciated that unit 10 may include any other suitable number, type, and position of humidity sensors according to alternative embodiments.

Referring again to FIG. 1, a schematic diagram of an external communication system 90 will be described according to an exemplary embodiment of the present subject matter. In general, external communication system 90 is configured for permitting interaction, data transfer, and other communications between air conditioner unit 10 and one or more external devices. For example, this communication may be used to provide and receive operating parameters, user instructions or notifications, performance characteristics, user preferences, or any other suitable information for improved performance of air conditioner unit 10. In addition, it should be appreciated that external communication system 90 may be used to transfer data or other information to improve performance of one or more external devices or appliances and/or improve user interaction with such devices.

For example, external communication system 90 permits controller 64 of air conditioner unit 10 to communicate with a separate device external to air conditioner unit 10, referred to generally herein as an external device 92. As described in more detail below, these communications may be facilitated using a wired or wireless connection, such as via a network 94. In general, external device 92 may be any suitable device separate from air conditioner unit 10 that is configured to provide and/or receive communications, information, data, or commands from a user. In this regard, external device 92 may be, for example, a personal phone, a smartphone, a tablet, a laptop or personal computer, a wearable device, a smart home system, or another mobile or remote device.

In addition, a remote server 96 may be in communication with air conditioner unit 10 and/or external device 92 through network 94. In this regard, for example, remote server 96 may be a cloud-based server 96, and is thus located at a distant location, such as in a separate state, country, etc. According to an exemplary embodiment, external device 92 may communicate with a remote server 96 over network 94, such as the Internet, to transmit/receive data or information, provide user inputs, receive user notifications or instructions, interact with or control air conditioner unit 10, etc. In addition, external device 92 and remote server 96 may communicate with air conditioner unit 10 to communicate similar information.

In general, communication between air conditioner unit 10, external device 92, remote server 96, and/or other user devices or appliances may be carried using any type of wired or wireless connection and using any suitable type of communication network, non-limiting examples of which are provided below. For example, external device 92 may be in direct or indirect communication with air conditioner unit 10 through any suitable wired or wireless communication connections or interfaces, such as network 94. For example, network 94 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 90 is described herein according to an exemplary embodiment of the present subject matter. However, it should be appreciated that the exemplary functions and configurations of external communication system 90 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Figure 4:
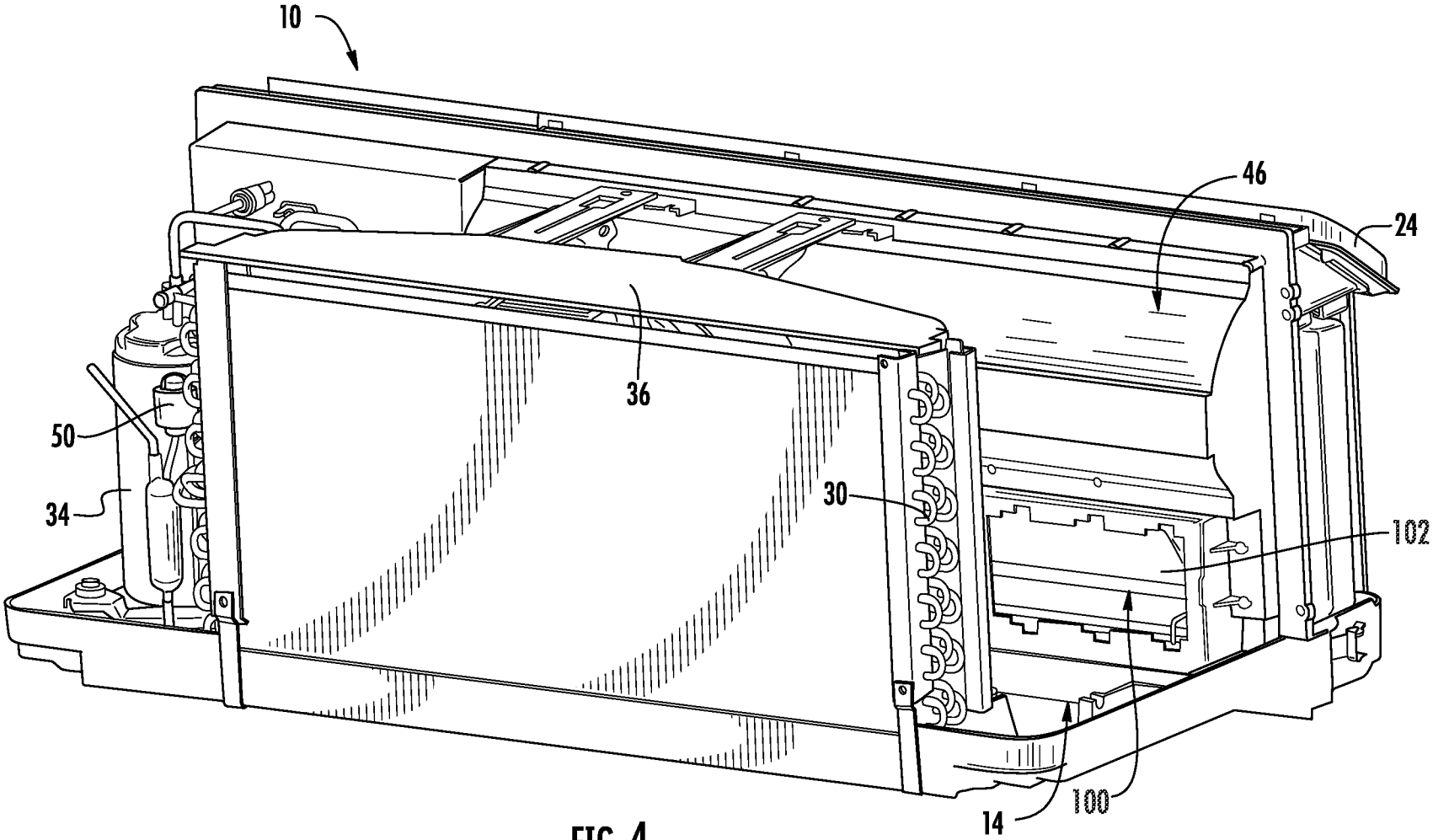
FIG. 4 is a rear perspective view of an outdoor portion of the exemplary air conditioner unit of FIG. 1, illustrating a vent aperture in a bulkhead in accordance with one embodiment of the present disclosure.

As explained briefly above, it may be desirable to periodically supplement the indoor air with make-up air from the outdoors. Accordingly, referring briefly to FIG. 4, a vent aperture 100 may be defined in bulkhead 46 for providing fluid communication between indoor portion 12 and outdoor portion 14. Vent aperture 100 may be utilized in an installed air conditioner unit 10 to allow outdoor air to flow into the room through indoor portion 12. In this regard, in some cases it may be desirable to allow outside air (i.e., "make-up air") to flow into the room in order, e.g., to meet government regulations, to compensate for negative pressure created within the room, etc. In this manner, according to an exemplary embodiment, make-up air may be provided into the room through vent aperture 100 when desired.

Figure 5:
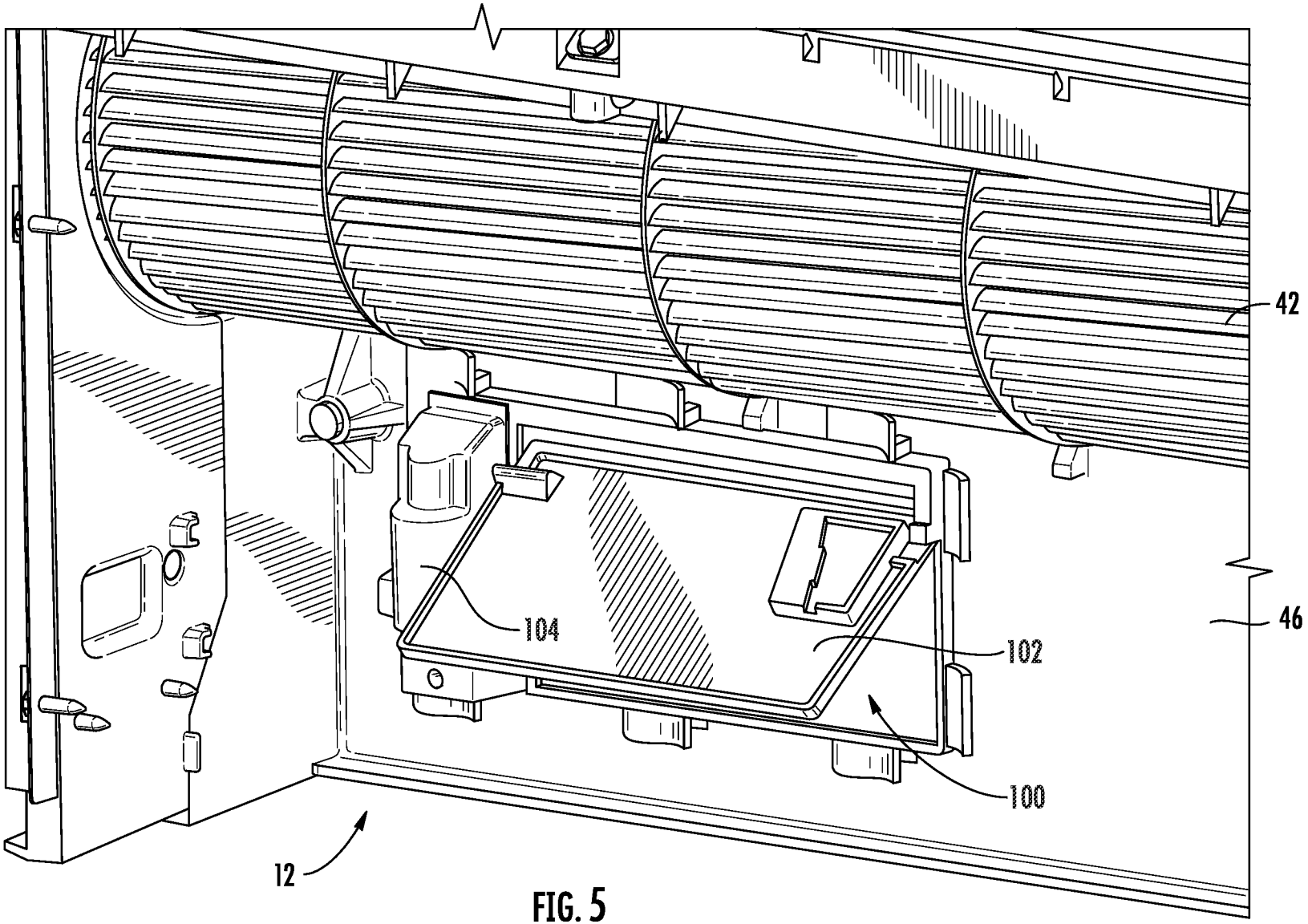
FIG. 5 is a front perspective view of the exemplary bulkhead of FIG. 4 with a primary vent door illustrated in the open position in accordance with one embodiment of the present disclosure.
Figure 6:
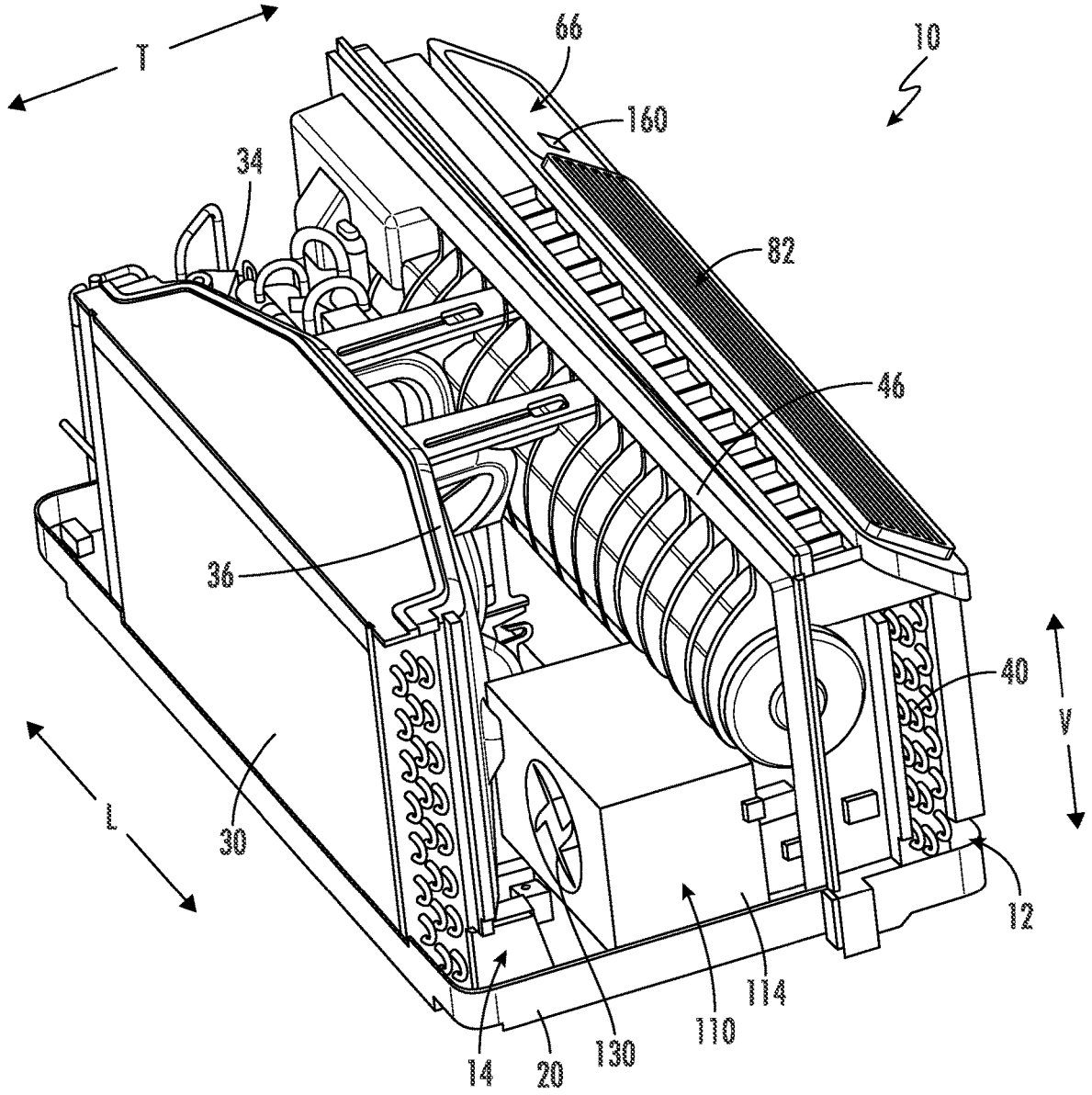
FIG. 6 is a rear perspective view of the exemplary air conditioner unit and bulkhead of FIG. 4 including a fan assembly for providing make-up air in accordance with one embodiment of the present disclosure.

As shown in FIG. 5, a vent door 102 may be pivotally mounted to the bulkhead 46 proximate to vent aperture 100 to open and close vent aperture 100. More specifically, as illustrated, vent door 102 is pivotally mounted to the indoor facing surface of indoor portion 12. Vent door 102 may be configured to pivot between a first, closed position where vent door 102 prevents air from flowing between outdoor portion 14 and indoor portion 12, and a second, open position where vent door 102 is in an open position (as shown in FIG. 5) and allows make-up air to flow into the room. According to the illustrated embodiment vent door 102 may be pivoted between the open and closed position by an electric motor 104 controlled by controller 64, or by any other suitable method.

In some cases, it may be desirable to treat or condition make-up air flowing through vent aperture 100 prior to blowing it into the room. For example, outdoor air which has a relatively high humidity level may require treating before passing into the room. In addition, if the outdoor air is cool, it may be desirable to heat the air before blowing it into the room. Therefore, as illustrated in FIGS. 6 through 10, unit 10 may further include a make-up air module 110 that is positioned over vent aperture 100 for conditioning make-up air.

Referring now to FIGS. 6 through 10, makeup air module 110 may generally be configured for supplying a flow of makeup air 112 from outdoor portion 14, through vent aperture 100, and into indoor portion 12. In this regard, according to the illustrated embodiment, makeup air module 110 may define a heat exchanger housing 114 through which the flow of makeup air 112 may pass into indoor portion 12. Notably, as described briefly above, the flow of makeup air 112 from outdoor portion 14 may have a temperature that would be uncomfortable if directed into the indoor portion 12 without being conditioned. For example, it is very cold outside, the flow of makeup air 112 may be cool or frigid, and injecting such air into the flow of indoor air 84 may result in poor system efficiency and user dissatisfaction. By contrast, if it is very warm outside, it may be desirable to lower the temperature of the flow of makeup air 112 before injecting it into the room.

Accordingly, makeup air module 110 may further include a heat exchanger 120 that is positioned within heat exchanger housing 114 for transferring thermal energy to or from the flow of makeup air 112 such that the temperature of the flow of makeup air 112 is more desirable and appropriate to the conditioning needs of the room. Specifically, according to the illustrated embodiment, heat exchanger 120 may generally define a primary flow path 122 through which the flow of makeup air 112 passes into the room. In addition, heat exchanger 120 may define an auxiliary flow path 124. As illustrated herein as described below, auxiliary flow path 124 may generally be configured for receiving a flow of auxiliary air 126 that is configured for transferring heat with the flow of makeup air 112, e.g., via heat exchanger 120.

More specifically, according to example embodiments, primary flow path 122 and auxiliary flow path 124 are fluidly isolated from each other while being thermally coupled to each other. For example, according to the illustrated embodiment, heat exchanger 120 is a crossflow air-to-air heat exchanger. In this regard, the flow of makeup air 112 and the flow of auxiliary air 126 may flow through fluidly isolated passages perpendicular to each other such that thermal energy may pass between the two flows while they may remain fluidly isolated. For example, according to the illustrated embodiment, heat exchanger 120 comprises a plurality of thin plates 128 stacked along the vertical direction V. These plates 128 at least partially define primary flow path 122 and auxiliary flow path 124 and may be used to separate the two flows.

Although primary flow path 122 and auxiliary flow path 124 are described as being fluidly isolated from each other, it should be appreciated that according to example embodiments, heat exchanger 120 may be capable of allowing both sensible heat transfer from warm side to cold side as well as letting water vapor permeate through the same membrane from high partial pressure (higher humidity) to lower partial pressure (lower humidity). For example, heat exchanger 120 may be an energy recovery ventilator (ERV) or a heat recovery ventilator (HRV), where an HRV is similar in appearance and size to an ERV but the membrane material separating the two flow streams may not permit water vapor to move across it.

According to the illustrated embodiment, makeup air module 110 may include one or more fan assemblies for selectively urging the flow of makeup air 112 and the flow of auxiliary air 126. In this regard, as illustrated, makeup air module 110 may generally include a primary fan 130 fluidly coupled to primary flow path 122 for urging the flow of makeup air 112 into indoor portion 12 through vent aperture 100. According to the illustrated embodiment, primary fan 130 may be positioned on an upstream end of heat exchanger 120. In addition, makeup air module 110 may include an auxiliary fan 132 that is fluidly coupled to auxiliary flow path 124 for drawing a flow of auxiliary air 126 through auxiliary flow path 124. According to the illustrated embodiment, auxiliary fan 132 may be positioned on the downstream end of heat exchanger 120.

According to the illustrated embodiment, both primary fan 130 and auxiliary fan 132 are axial fans. However, it should be appreciated that any other suitable number, type, and configuration of fan or blower could be used to urge a flow of makeup air 112 and auxiliary air 126 according to alternative embodiments. In addition, primary fan 130 and auxiliary fan 132 may be positioned in any other suitable location within makeup air module 110. The embodiments described herein are only exemplary and are not intended to limit the scope of the present subject matter.

According to example embodiments, controller 64 of unit 10 may be operably coupled to primary fan 130 and auxiliary fan 132 for regulating the flow of make-up air 112 and the flow of auxiliary air 126, respectively. It should be appreciated that these fans may be operated at the same speed or at a different speed depending on ambient conditions in the room or outside conditions. For example, the flow rate of the flow of make-up air 112 is typically dictated by the make-up air needs within the room, e.g., based on government regulations, occupancy, bathroom fan operation, etc. Similarly, the outside temperature and humidity may require different flow rates of the flow of auxiliary air 126 to suitably condition the flow of make-up air 112 prior to introduction into the room.

Thus, according to example embodiments, controller 64 may dynamically adjust the flow rates of each of the flow of make-up air 112 and the flow of auxiliary air 126 depending on various atmospheric and operating conditions. According to an example embodiment, it may be desirable to operate the primary fan 130 and the auxiliary fan 132 at the same flow rate. In general, the target flow rate for the flow of make-up air 112 and the flow of auxiliary air 126 may be between about 10 and 60 cubic feet per minute (cfm), between about 20 and 50 cfm, between about 30 and 40 cfm, or about 35 cfm.

Referring still to FIGS. 6 through 10, makeup air module 110 may generally define an energy recovery duct 140 that is generally configured for providing fluid communication between indoor portion 12 and auxiliary flow path 124 through exchanger 120. In this regard, bulkhead 46 may generally define a recovery port 142 between indoor portion 12 and energy recovery duct 140. For example, according to the illustrated embodiment, recovery port 142 is defined at the left of heat exchanger 120 when viewed from a front of unit 10. Accordingly, the flow of auxiliary air 126 may pass from indoor portion 12, through recovery port 142 and recovery duct 140, and through heat exchanger 120. Notably, if the flow of makeup air 112 is cool (e.g., during winter), residual heat from the flow auxiliary air 126 may be transferred to the flow of make-up air 112 of such that its temperature is increased prior to passing into the indoor portion 12. As explained above, this may improve the operating efficiency of while also improving occupant comfort and satisfaction.

According to example embodiments, it may be desirable to further heat the flow of auxiliary air 126 prior to passing it into heat exchanger 120. For example, heater bank 60 may be energized for selectively heating the flow of auxiliary air 126 prior to passing through recovery port 142. In this manner, if the flow of makeup air 112 entering heat exchanger 120 is particularly cool, additional heat may be added to the air using heater bank 60 to increase the discharge temperature of the flow of makeup air 112 and improve occupant comfort.

Figure 8:
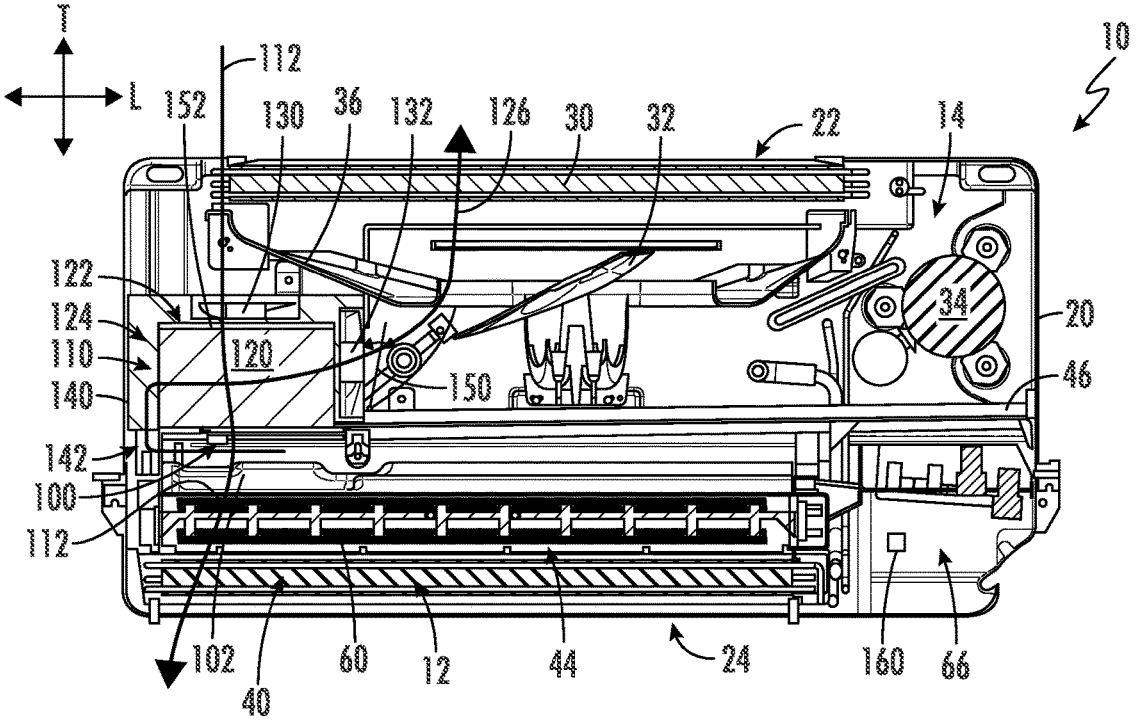
FIG. 8 is a top cross-sectional view of the exemplary air conditioner unit of FIG. 1 in accordance with an embodiment of the present disclosure.
Figure 9:
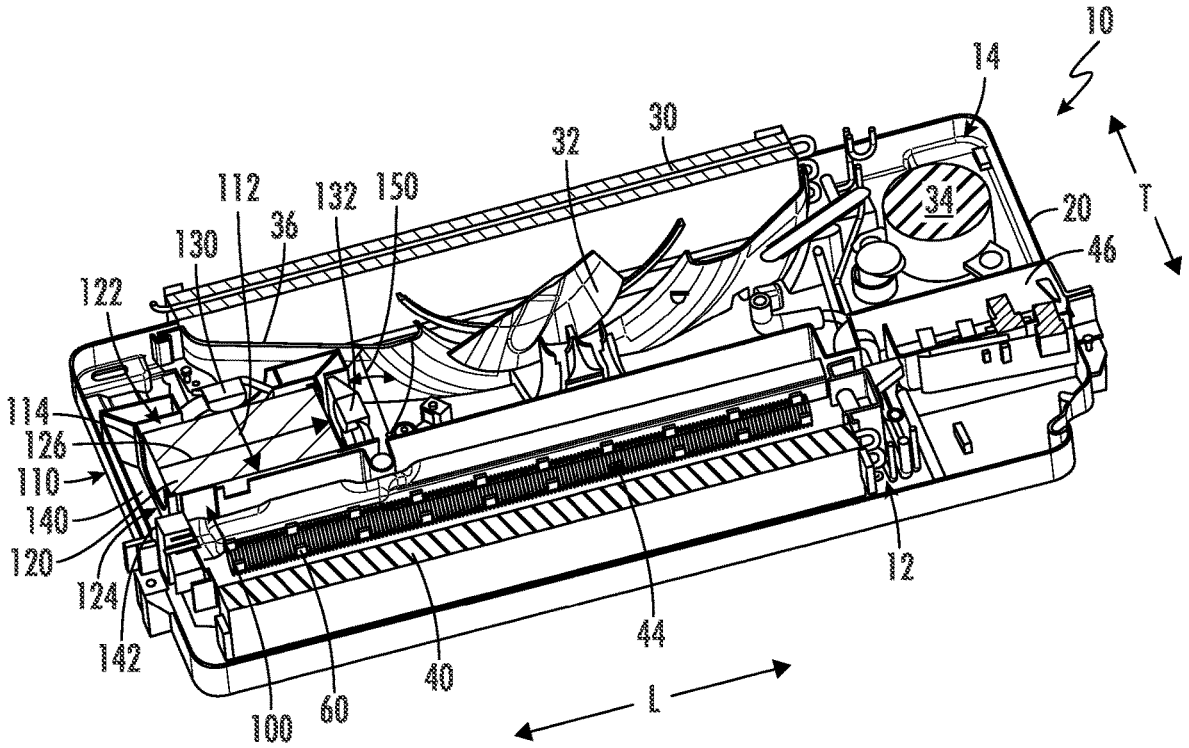
FIG. 9 is a perspective cross-sectional view of the exemplary air conditioner unit of FIG. 1 in accordance with an embodiment of the present disclosure.
Figure 10:
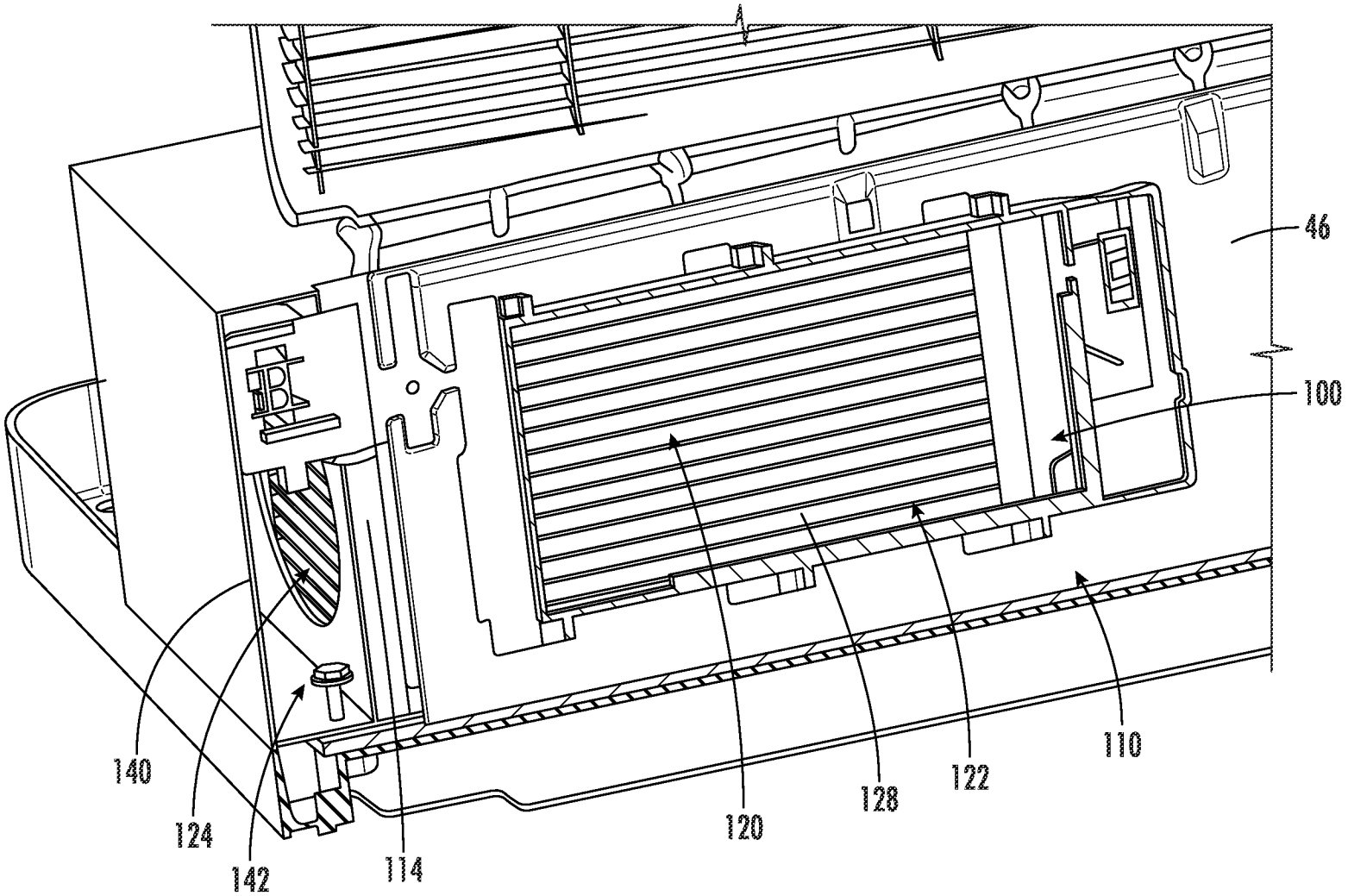
FIG. 10 is a perspective cross-sectional view of the exemplary air conditioner unit of FIG. 1 in accordance with an embodiment of the present disclosure.

Referring now specifically to FIGS. 8 and 9, according to the illustrated embodiment, recovery duct 142 may further extend downstream of heat exchanger 120. Recovery duct 140 may be fluidly coupled to a condenser shroud or fan shroud 36 that is positioned around outdoor heat exchanger 30. In this manner, the flow of auxiliary air 126 may be fluidly isolated or separated from the flow of makeup air 112. In addition, the flow of auxiliary air 126 may transfer thermal energy with outdoor heat exchanger 30.

Notably, it may be desirable to periodically stop the flow of makeup air 112 and/or the flow of auxiliary air 126. Accordingly, unit 10 or makeup air module 110 may further include one or more doors that are pivotable between an open and closed position to permit or restrict the respective flows of air. For example, vent door 102 may be positioned in the bulkhead 46 for restricting the flow of makeup air 112. In addition, or alternatively, makeup air module 110 may define a vent door, e.g., on an upstream side of primary fan 130 within primary flow path 122. In addition, as shown schematically in FIG. 8, and auxiliary door 150 may be operably coupled to auxiliary flow path 124, e.g., downstream from heat exchanger 120. In this manner, auxiliary door 150 may be open to permit the flow of auxiliary air 126 and may be closed to restrict or stop the flow of auxiliary air 126.

Referring still to FIG. 8, it may be desirable to filter the flow of makeup air 112 before introducing it into indoor portion 12. Accordingly, makeup air module 110 may further include a filter 152 that is positioned within primary flow path 122 for filtering the flow of makeup air 112. It should be appreciated that filter 152 may be any suitable type, position, and configuration of filtering mechanisms. For example, filter 152 may be a screen filter, a pleated filter, an electrostatic filter, a carbon filter, a fiber glass filter, or any other suitable type of filter. Although filter 152 is illustrated as being positioned downstream of primary fan 130, it should be appreciated that filter 152 may alternatively be positioned at any other suitable location within primary flow path 122.

According to example embodiments, the operation of make-up air module 110 may depend on the presence of occupants within the room being conditioned. Accordingly, unit 10 may further include an occupancy detection sensor 160 for detecting room occupancy. For example, occupancy detection sensor 160 may be a motion sensor, a proximity sensor, or any other suitable sensor positioned on the room front 24 of unit 10. According to still other embodiments, occupancy detection sensor 160 may be a thermostat, a room door sensor, a keycard access pad, or any other suitable device capable of detecting room occupancy and communicating such a status to controller 64 of unit 10.

According to an example embodiment, controller 64 may generally be configured to detect occupant presence using the occupancy detection sensor 160 and operate the make-up air module 110 in response to detecting occupant presence. In this regard, for example, when an occupant is detected, controller 64 may operate primary fan 130 at a target air flow rate (e.g., 35 cfm). If it is cool outside and the flow of air 84 is too cool for occupant comfort, e.g., as measured by a temperature sensor (e.g., indoor temperature sensor 86), controller 64 may operate auxiliary fan 132 at a target flow rate (e.g., also 35 cfm), thereby passing relatively warm air through the heat exchanger 120 to heat the flow of make-up air 112. According to still other embodiments, controller 64 may energize heater bank 60 to provide more thermal energy into the flow of auxiliary air 126, thus heating the flow of make-up air 112.

As explained herein, aspects of the present subject matter are generally directed to an energy recovery ventilator within PTAC appliance. A crossflow plate heat exchanger may be installed on the outdoor side of a PTAC and installed with fresh air supply into the room on one loop and room exhaust into a perpendicular loop. The use of two vents to separate the air flow paths may be supplemented by adding bulkhead slots with motorized doors and makeup fans for each side. The system may operate based on occupant settings or detected occupant presence.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:
- a bulkhead defining an indoor portion and an outdoor portion;
- a vent aperture defined in the bulkhead; and
- a make-up air module for urging a flow of make-up air from the outdoor portion through the vent aperture to the indoor portion, the make-up air module comprising:
  - a heat exchanger defining a primary flow path and an auxiliary flow path, wherein the primary flow path is fluidly isolated and thermally coupled to the auxiliary flow path;
  - an energy recovery duct providing fluid communication between the indoor portion and the auxiliary flow path;
  - a primary fan fluidly coupled to the primary flow path for urging the flow of make-up air into the indoor portion through the vent aperture; and
  - an auxiliary fan fluidly coupled to the auxiliary flow path for drawing a flow of auxiliary air through the energy recovery duct and the auxiliary flow path.

2. The air conditioner unit of claim 1, further comprising:
- a vent door operably coupled to the primary flow path.

3. The air conditioner unit of claim 1, further comprising:
- a filter positioned in primary flow path for filtering the flow of make-up air.

4. The air conditioner unit of claim 1, wherein a recovery port to the energy recovery duct is defined in the bulkhead.

5. The air conditioner unit of claim 4, further comprising:
- a heater bank positioned within the indoor portion for selectively heating a flow of indoor air, wherein the recovery port is defined adjacent the heater bank for heating the flow of auxiliary air.

6. The air conditioner unit of claim 1, further comprising:
- a controller operably coupled to the primary fan and the auxiliary fan, the controller being configured to operate the primary fan and the auxiliary fan at a target fan speed for generating a target flow rate.

7. The air conditioner unit of claim 6, wherein the target flow rate is between about 30 and 40 cubic feet per minute.

8. The air conditioner unit of claim 1, wherein the heat exchanger is a crossflow air-to-air heat exchanger.

9. The air conditioner unit of claim 1, wherein the energy recovery duct is fluidly coupled to a condenser shroud positioned over an outdoor heat exchanger.

10. The air conditioner unit of claim 1, further comprising:
- an occupancy detection sensor; and
- a controller operably coupled to the occupancy detection sensor, the controller being configured to:
  - detect occupant presence using the occupancy detection sensor; and
  - operate the make-up air module, the primary fan, and auxiliary fan in response to detecting occupant presence.

11. A make-up air module for an air conditioner unit, the air conditioner unit comprising a bulkhead defining an indoor portion and an outdoor portion and a vent aperture defined in the bulkhead, the make-up air module comprising:
- a heat exchanger defining a primary flow path and an auxiliary flow path, wherein the primary flow path is fluidly isolated and thermally coupled to the auxiliary flow path;
- an energy recovery duct providing fluid communication between the indoor portion and the auxiliary flow path;
- a primary fan fluidly coupled to the primary flow path for urging a flow of make-up air into the indoor portion through the vent aperture; and
- an auxiliary fan fluidly coupled to the auxiliary flow path for drawing a flow of auxiliary air through the energy recovery duct and the auxiliary flow path.

12. The make-up air module of claim 11, further comprising:
- a vent door operably coupled to the primary flow path.

13. The make-up air module of claim 11, further comprising:
- a filter positioned in primary flow path for filtering the flow of make-up air.

14. The make-up air module of claim 11, wherein a recovery port to the energy recovery duct is defined in the bulkhead.

15. The make-up air module of claim 14, further comprising:
- a heater bank positioned within the indoor portion for selectively heating a flow of indoor air, wherein the recovery port is defined adjacent the heater bank for heating the flow of auxiliary air.

16. The make-up air module of claim 11, further comprising:
- a controller operably coupled to the primary fan and the auxiliary fan, the controller being configured to operate the primary fan and the auxiliary fan at a target fan speed for generating a target flow rate.

17. The make-up air module of claim 16, wherein the target flow rate is between about 30 and 40 cubic feet per minute.

18. The make-up air module of claim 11, wherein the heat exchanger is a crossflow air-to-air heat exchanger.

19. The make-up air module of claim 11, wherein the energy recovery duct is fluidly coupled to a condenser shroud positioned over an outdoor heat exchanger.

20. The make-up air module of claim 11, further comprising:

an occupancy detection sensor; and a controller operably coupled to the occupancy detection sensor, the controller being configured to:

detect occupant presence using the occupancy detection sensor; and operate the make-up air module, the primary fan, and auxiliary fan in response to detecting occupant presence.

* * * * *